United States Patent [19]

Alin

[11] 4,104,017

[45] Aug. 1, 1978

[54] METALLIC NON-PREMIXED GAS-BURNER WITH COUNTER-ROTATION OF GASES

[75] Inventor: Jean-Marie Georges Fernand Alin, Le Plessis Belleville, France

[73] Assignee: Gaz de France, Paris, France

[21] Appl. No.: 782,629

[22] Filed: Mar. 30, 1977

[30] Foreign Application Priority Data

Feb. 1, 1977 [FR] France ..... 77 02749

[51] Int. Cl.[2] ..... F23D 15/02

[52] U.S. Cl. ..... 431/352; 431/173

[58] Field of Search ..... 431/158, 10, 352, 173; 110/28 F

[56] References Cited

U.S. PATENT DOCUMENTS 3,273,623 9/1966 Nesbitt ..... 431/352

3,951,584 4/1976 Thekdi ..... 431/352

*Primary Examiner*—Alan Cohan

*Attorney, Agent, or Firm*—Silverman, Cass & Singer, Ltd.

[57] ABSTRACT

The metallic gas-burner of the invention comprises a central fire-tube constituting a mixing and combustion chamber into which is admitted a fuel-gas and a gaseous combustion agent from an annular air-box surrounding the fire-tube.

The fuel-gas is supplied at a low pressure into the rear of the fire-tube and the gaseous combustion agent is distributed at a low pressure into the fire-tube, in the form of at least three main flows from the rear to the front of the tube, the second and third flows being provided in counter-rotation relationship.

12 Claims, 3 Drawing Figures

METALLIC NON-PREMIXED GAS-BURNER WITH COUNTER-ROTATION OF GASES

The present invention relates to a metallic gas-burner with counter-rotation of gases, allowing a high temperature of the burnt gases to be obtained.

The gas burners which allow intensive combustion to be obtained and are frequently used in the prior art are those in which means are provided for a premixing of the fuel gas with a gaseous combustion agent such as in particular air. This type of burner suffers from various drawbacks consisting in particular in that it does not offer high flexibility of operation, the air factor range ensuring the stability of the combustion being relatively narrow, and also in that it involves explosion hazards and therefore difficulties in use.

On the other hand, burners are known that operate without air and fuel gas premixing, in which the combustion takes place as the air and the fuel gas meet each other; such burners offer the advantage of being free of flash-back but they do not generally allow a complete intensive combustion and a very high flexibility of operation to be obtained simutaneously.

The present Applicant has developed non-premixed burners ensuring intensive or high-speed combustion and considerably improved flexibility of operaion, especially from the point of view of the aeration ratio, as compared with the premixed burners in current use.

A burner of that type forms the subject matter of French Pat. No. 71 17828 filed on May 17, 1971. This block burner, referred to as an "air-gas counter-rotation" burner, requires, with natural gas, a gas supply pressure on the order of one to two bars. This equipment has amply proved to be efficient in industrial operation, but since gas at the required pressure is not available to all potential users, it has been endeavoured to develop on the same basic principles another burner operating on gas at low pressure, e.g. on the order of a few tens of millibars.

Such a non-premixed burner is the block burner disclosed in French Pat. No. 73 38298 operation, in France on Oct. 26, 1973 in the name of the present Applicant. This burner comprises a mixing chamber provided with low-pressure fuel-gas intake means and two sets of means for the intake of compressed air in counter-rotation, as well as a combustion chamber extending in axial prolongation of the said mixing chamber towards the front end of the burner. As in the burner described previously, the combustion takes place and stabilizes after the mixing chamber, in the refractory combustion chamber of the block burner.

The evolution of furnace heating techniques has revealed the advantage offered by high-velocity gas outflow burners or jet burners. This technique allows:

- an increase in heat transmission by ensuring considerable convection in addition to the heat radiation prevailingly used in the prior art;
- temperature homogeneity and temperature accuracy never hitherto attained, and due to the stirring of the air.

Now it is technically impossible to make real jet burners with a refractory combustion chamber with a power exceeding 100 th/h; if the combustion is intensive the combustion chamber rapidly cracks and the burner loses its characteristics; if the combustion is not intensive, the combustion chamber resists, but the burner is not a jet burner.

In order to solve this problem the present Applicant has designed entirely metallic burners ensuring an intensive and substantially adiabatic combustion. The present invention relates to burners in which the combustion velocity is still higher and which are provided with a system of aerodynamic cooling of its walls so as to allow them to withstand extremely high flame temperatures and offering, in addition to the advantages of the above-mentioned burners, other specific advantages.

The metallic gas-burner according to the invention, ensuring a high gas outflow velocity and allowing a high temperature of the burnt gases to be obtained, is of the type comprising a central fire-tube constituting a mixing and combustion chamber into which is admitted, on the one hand, a fuel gas and, on the other hand, a gaseous combustion chamber, usually air, from an annular space constituting an air box provided between the outer walls of the said fire-tube and an external tube surrounding it, the said burner being characterized in that the fuel gas is supplied at a low pressure, e.g. on the order of a few tens of millibars into the rear of the fire-tube, whereas the gaseous combustion agent is distributed at a low pressure into the said fire-tube in the form of at least essentially three main flows from the rear to the front of the said tube, the first flow being supplied in a transverse plane near the rear wall of the said fire-tube, whereas the second and third flows are supplied in counter-rotation relationship with respect to one another, the said second flow being supplied into the rear portion of the fire-tube and the said third flow being supplied into its front portion beyond the medial transverse plane of the said tube, respectively.

Such a burner differs from the non-premixed burners known hitherto and more particularly from the burner disclosed in French Pat. No. 73 38298, in the following essential respects:

(1) it has no refractory chamber serving as a combustion chamber distinct from the mixing chamber; quite on the contrary the central fire-tube constitutes both a mixing chamber and a combustion chamber;

(2) since the fuel-gas is supplied into the rear of the fire-tube, the gaseous combustion agent is supplied into the fire-tube no longer in the form of two air flows in counter-rotation very close to one another, but in the following manner:

an air stream reaching the rear of the chamber is divided into two flows quite distinct from one another, i.e. a first flow entering the fire-tube in a transverse plane and a second flow which, on entering the fire-tube slightly downstream of the said first flow with respect to the direction of the gas flow, is imparted a rotary motion. The first flow enters the tube radially and in orthogonal relationship to the axial flow of the fuel-gas in the fire-tube.

Such an arrangement provides a partial premixing of air and fuel gas which ensures a piloting of the main combustion. This stabilization is obtained without any auxiliary device and without using an intermediate chamber or a mixing box. The partial premixing takes place by way of diffusion and re-circulation in the rear portion of the combustion chamber.

The second, rotating flow supplied tangentially to the wall of the fire-tube offers in particular the advantage of providing a first complementary amount of gaseous combustion agent and of allowing a rapid maximum circulation of air in contact with the inner wall of the fire-tube so as to avoid excessive heating at any point of the said wall;

a third flow of gaseous combustion agent is introduced tangentially into the front portion of the fire-tube, beyond the medial transverse plane of the latter, in counter-rotation relationship to the said second flow, an important spacing being provided between the two counter-rotation planes. The intense turbulence obtained in this region as a result of the impact of the gaseous flows in counter-rotation relationship to one another leads to rapid mixing which promotes and ensures the completion of the combustion reactions. As in the region of the second flow of the first stream, this tangential intake of gaseous combustion agent ensures the protection and an excellent cooling of the inner wall of the front portion of the fire-tube.

The whole set of the above specific arrangements has the following effects:

(1) improvement of the capacity, flexibility and stability of operation of the burner by piloting the combustion at the bottom of the fire-tube, perfectly stabilizing the combustion from the very rear region of the chamber under any operating conditions, and the use of the whole volume of the chamber by the intensive combustion;

(2) increase in the intensity of combustion and production of high temperatures and velocities of the combustion products in the outflow section, as well as a limitation of the apparent flame to a considerably reduced cone having a length on the order of 300 mm approximately.

These results are attained in particular without introducing any important loss of pressure of the fuel-gas and the combustion agent.

According to a preferred form of embodiment of the invention, the intakes of gaseous combustion agent in counter-rotation relationship to one another in the fire-tube of the burner have such gyratory moments that there subsists a partial residual rotation of the fuel mixture. Thus, the flow rate of the gaseous combustion agent in rotation in the rear of the chamber will be lower than that of the flow in counter-rotation in the front portion of the chamber.

According to still another preferred form of embodiment of the invention, a fourth, annular intake of gaseous combustion agent into the fire-tube is ensured, at the front end of the burner, in contact with the wall of the said tube in counter-flow relationship to the axial flow of the gases in the fire-tube.

This particular construction, ensuring a return of the air flow at the end of the burner, increases the cooling of the front plate and of the fire-tube, on the one hand, and provides on the other hand a region of zero velocity of the gas flow in contact with the wall, between the front tangential intake of the combustion agent and the orifice of the burner; there are thus obtained a better stabilization of the flame within the high-power burner and the possibility of increasing the distance from the plane of the orifices for the third flow to the outlet of the burner, so as to improve the intensity of the combustion in the chamber. This, in combination with the arrangement allowing the clinging of the flame at the rear portion of the chamber, allows the power range of the novel burner according to the invention to be substantially widened.

The invention will appear more clearly from the following description made with reference to the appended drawings given solely be way of example and wherein:

FIG. 1 is a longitudinal sectional view of a burner shown diagrammatically;

Figure 4:
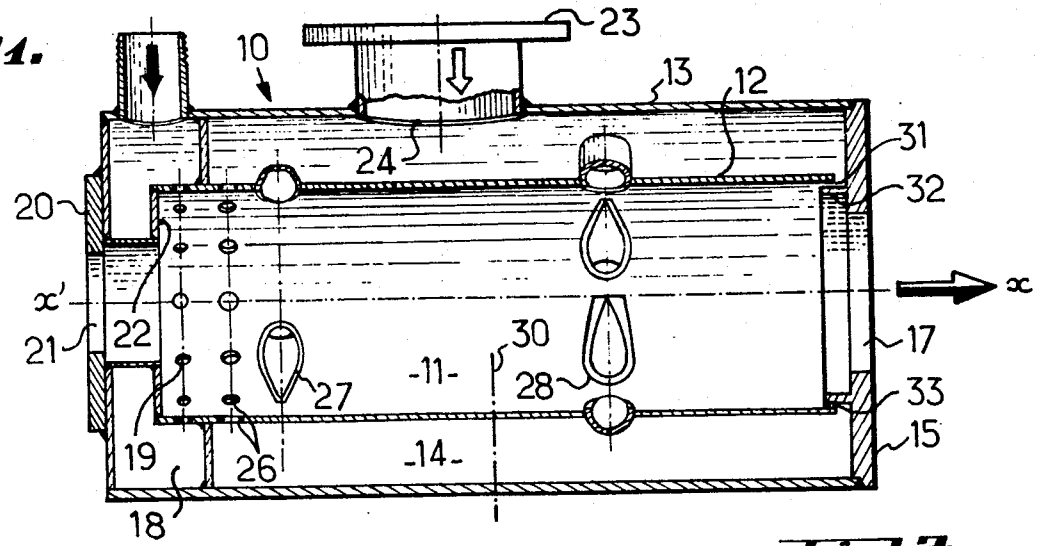

According to the form embodiment illustrated in FIG. 1, the burner 10 according to the invention comprises a fire-tube 11 having a substantially cylindrical circular metal wall 12. The fire-tube 11 is surrounded in spaced relationship and throughout substantially its whole length with the wall 13 of an external tube, thus defining an annular space constituting an air box 14 extending in coaxial relationship to the fire-tube 11 and embracing the latter. The burner 10 is provided at its front portion with a plate 15 closing the air box 14 and extending beyond the fire-tube so as to define a gas outlet opening 17 smaller in diameter than the fire-tube 11. The rear portion of the burner comprises, upstream of the air box 14 with respect to the direction of flow of the gases, a fuel-gas box 18 and fuel-gas intake means opening radially into the fire-tube 11 through orifices 19. The bottom of the burner is closed by a plate 20 in which is provided an orifice or sight hole 21.

The air enters the air box 14 through an air intake 23 opening in substantially perpendicular relationship to the centre line $x'x$ of the burner through an orifice 24 in radial relationship to the wall 13 of the said air box; therefrom the air enters the fire-tube 11 by traversing the wall 12 through three series of orifices such as 26, 27, 28 located in three distinct transverse planes, respectively, of the said fire-tube. The orifices such as 26 have small openings and provided a radial air intake into the rear of the fire-tube 11. The orifices such as 27, also located in the rear portion of the fire-tube, slightly downstream of the plane of the orifices 26, have each a larger section than that of the orifices 26 and provide a tangential inlet of air in rotation within the fire-tube 11. Beyond the medial transverse plane 30 of the burner, an air inlet, which also is tangential, is provided through the orifices 28 having an opening section substantially equal to that of the orifices 27, but greater in number than the latter and in counter-rotation relationship with respect thereto. A fourth intake of combustion air into the fire-tube 11 is ensured at the front portion of the burner, through a gap 31 provided between a ring 32 integral with the front plate 15 of the burner, and even turned in a single piece with the latter, and the front end portion of the wall 12, the said gap being secured by centering spacers such as 23.

The fuel-gas entering the fire-tube through the orifices 19 first meets the air stream from the orifices 26, resulting in a premixing of the air and the fuel-gas, starting from the very bottom of the chamber. According to a preferred form of embodiment of the invention, a sufficient number of small openings 26 are provided to ensure in that region an air flow rate of the same order of magnitude as that of the rotating air stream arriving through the openings 27.

On the other hand it will be noted that according to the embodiment of the burner illustrated in FIG. 1, the rotating air flow rate at the rear of the chamber (three openings 27) is equal to half the rate of flow in counter-rotation at the front of the chamber (six openings 28). This is an example illustrating a type of partial counter-rotation which can advantageously be used within the scope of the present invention.

Of course the number of air admission openings and their respective sections may vary according to the aim to be achieved.

The velocity of the gases flowing out after the combustion is increased by the constriction ensured by the portion of the front plate 15 of the burner that extends radially beyond the edges of the fire-tube. This constriction may be more or less important and may even not be provided in some cases. It will be noted that these burners cover a wide range as regards the outflow velocity of the combustion products; this velocity may readily vary in a ratio of 1 to 3 depending on the opening provided in the front plate. At nominal power, for example with a maximum opening, there is obtained an intensive burner from which the products escape with a velocity of about 70 m/s, whereas with a small opening the burner operates as a high-velocity burner or jet burner, the products of which reach and may even exceed 250 meters per second.

It will be noted that the fuel-gas intake may be achieved by any known arrangement, but preferably in a transverse plane of the fire-tube, for example radially as illustrated, in order to prevent too rapid a circulation of the fuel-gas along the tube. Thus, the fuel-gas may even be admitted through axial orifices provided at the bottom 22 and so shaped that the fuel-gas admitted into the fire-tube will arrive with as low an axial velocity component as possible.

Likewise, the fuel-gas may be supplied at the bottom of the fire-tube through an axial pole or the like ensuring a divergent radial flow. This arrangement would replace the fuel box 18, the volume of which would then form part of the air box 14.

In all cases a cushion of gas at low axial-flow velocity is thus created at the rear of the fire-tube.

The orifice 21 provided in the bottom plate of the burner allows the mounting of various additional devices such as in particular an ignition plug, a flame control device, an optical inspection device and possibly a pilot device, or the introduction of various auxiliary substances apt to participate in the combustion within the burner.

Figure 3:
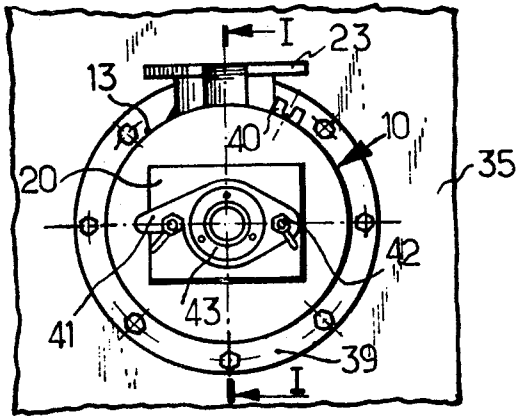
FIG. 3 is an end view of the burner shown in FIG. 2, to the section I—I of which corresponds the burner shown in FIG. 1, without accessory devices.
Figure 2:
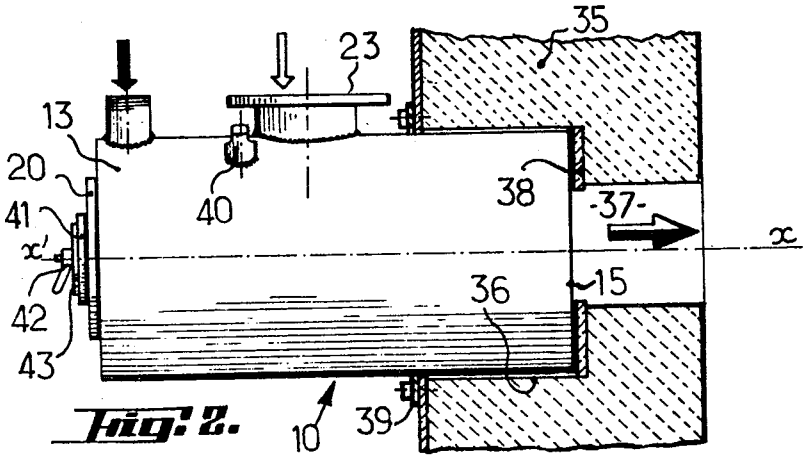
FIG. 2 is a side view of a burner according to the invention, shown with its accessories and mounted in the wall of a furnace shown in section.

The burner shown in FIGS. 2 and 3 illustrates more specifically the accessories which may be provided on the burner 10, e.g. a plug support 40 substantially in the region of the transverse plane of intake of the second flow of gaseous combustion agent 27, as well as a pivotable sighting system 41 mounted through the medium of weldable studs 42 and of a fastening ring 43 on the rear plate 20 of the burner.

Referring more particularly to FIG. 2, there is seen a burner 10 mounted on the wall 35 of a furnace: the burner is placed in a recess constituted by a set-back 36 in the wall 25 and is secured by means of a fastening flange 39. The combustion products enter the furnace through a passage 37. A fibrous refractory ring 38 compressed between the wall 35 and the front end of the burner protects the latter from furnace radiation while at the same time compensating for the possible expansions and plays.

Of course the mounting of the burner on a furnace may also be performed according to any other suitable arrangement, in particular by placing the front portion of the burner in a circular orifice provided in the sheet-metal casing and the insulation of the furnace, a lateral clearance of 2 to 3 cm allowing an easy mounting; this space is thereafter filled with fibrous refractory in such a manner as to compensate for the plays and differential expansions; such a mounting is therefore suitable on furnaces the assigned temperature of which does not exceed 1000° C.

It is of course obvious that use can be made of any other mounting of the burner on the furnace, including mountings designed to allow recovery of part of the sensible heat of the fumes. This applies in particular to the case where the central portion of the burner is unchanged but is surrounded with a metal recuperator, more particularly of the parallel flow type.

By way of example the table below illustrates the number and dimensions of the intake openings for the gaseous combustion agent from the rear towards the front of the burner, in two burners designed according to the invention with a nominal power of 200 and 400 th/h, respectively.

TABLE 1.

| Nominal Power | | 200 th/h | | 400 th/h | |
|---|---|---|---|---|---|
| | | number of openings | diameter (mm) | number of openings | diameter (mm) |
| Rear intake | radial | 12 | 12 | 24 | 12 |
| | tangential | 2 | 20–27 | 3 | 26–34 |
| Front intake | tangential | 4 | 20–27 | 6 | 26–34 |
| | annular | 1.5 mm clearance on 105 mm diameter | | 1.5 mm clearance on 159 mm diameter | |

In the form of embodiment of the burner with a nominal power of 400 th/NCV/h (NCV = net calorific value), Groningen natural gas is supplied as fuel (composition: $CH_4$: 81.1 – $N_2$: 14.2 – $C_2H_6$: 3 – $C_3H_8$: 0.6 – $C_3H_{10}$: 0.2 – $CO_2$: 0.9) at a flow rate comprised between 15 and 75 $Nm^3/h$ (volume under normal temperature and pressure conditions) for a chamber volume of the order of 9.7 liters.

Under stoichiometric combustion conditions, the mean temperature reached by the combustion products in the outlet section is on the order of 1750° C, and with an opening of 85 mm in diameter the outflow velocity of the gases reaches 175 m/s at nominal power.

Under such conditions the static pressure in the chamber is 50.5 millibars, the supply pressures being 57.5 millibars for the fuel gas and 53 millibars for the cold combustion air. The pressure in the chamber corresponds to the acceleration of the burnt gases and the pressure losses attributable to the mixing process and the stabilization of the combustion amount to only 7 millibars for the fuel-gas and 2.5 millibars for the air. On the other hand, the design of this equipment, especially in so far as the aerodynamic cooling of the inner and outer walls of the central fire-tube is concerned, results in a situation where, with a combustion temperature of 1750° C in the interior, the temperature at any point of the said tube never exceeds 650° C.

The heating power furnished by such a burner operating on Groningen gas may vary within a range of the order of from 120 th/h to 550 th/h, with a flexibility of the aeration ratio $n$ comprised between a lower value equal to 0.5 and an upper value varying from 20 to 2, without flame blowing, a perfect lighting of the burner being obtained as soon as the gas is turned on.

Of course the invention is by no means limited to the forms of embodiment described and illustrated which have been given by way of example only. In particular, it comprises all means that constitute technical equivalents to the means described, as well as their combinations should the latter be carried out according to its gist and within the scope of the following claims. For example, in some cases, it may be contemplated to provide a non-radial, e.g. tangential air inlet in the air box 14.

What is claimed is:

1. A metallic gas-burner with high-velocity gas outflow allowing a high temperature of the burnt gases to be obtained, of the type comprising a central fire-tube comprising a rear portion closed by a rear wall, and a front portion on both sides of a medial transverse plane, said fire-tube constituting a mixing and combustion chamber into which is admitted, on the one hand, a fuel-gas and, on the other hand a gaseous combustion agent usually air, from an annular space constituting an air box provided between the outer wall of the said fire-tube and an external tube surrounding it, the said burner being provided at its front end portion with a front plate closing the said air-box, wherein the fuel gas is supplied at a low pressure, e.g. on the order of a few tens of millibars, into the rear of the fire-tube by a fuel-gas intake and the gaseous combustion agent is distributed at a low pressure into the said fire-tube in the form of at least essentially three main flows from the rear to the front of the said tube, the intake of the first flow being provided in a transverse plane close to the rear wall of the said fire-tube, the intakes of the second and third flows being provided in counter-rotation relationship with respect to one another, the second flow being fed into the rear portion of the fire-tube and the said third flow being fed into its front portion beyond the said medial transverse plane respectively.

2. A burner according to claim 1, wherein the gyratory moments of the said second and third flows of gaseous combustion agent in counter-rotation relationship with respect to one another are such that there subsists a partial residual rotation of the fuel mixture.

3. A burner according to claim 1, wherein a fourth annular intake of gaseous combustion agent into the fire-tube is ensured at the front end of the burner, in substantially counter-flow relationship to the flow of the gases in the fire-tube.

4. A burner according to claim 2, wherein the flow rate of the said second flow of gaseous combustion agent is lower than the flow rate of the said third flow of gaseous combustion agent.

5. A burner according to claim 4, wherein the flow rate of the said second flow of gaseous combustion agent is substantially equal to half the flow rate of the said third flow of gaseous combustion agent.

6. A burner according to claim 3, wherein the said fourth, annular intake of gaseous combustion agent takes place from the air-box through a gap provided between a ring interval with the said front plate of the said burner and the front end portion of the fire-tube.

7. A burner according to claim 1, wherein, in a manner known per se, the said front plate of the burner is provided with a part extending beyond the said fire-tube so as to ensure a constriction of the outlet section and to increase the outflow velocity of the burnt gases.

8. A burner according to claim 1, wherein the said first flow of gaseous combustion agent close to the rear wall of the said fire-tube is distributed radially.

9. A burner according to claim 1; wherein, the intake of fuel-gas takes place at the rear end of the fire tube, rearward of the various flows of gaseous combustion agent admitted into the burner.

10. A burner according to claim 9, wherein the intake of fuel-gas into the rear of the fire-tube takes place in a transverse plane of the said fire-tube, e.g. radially, a little rearward of the first gaseous combustion agent intake.

11. A burner according to claim 1, wherein the intake of the first flow of gaseous combustion agent takes place through a great number of small openings, the intake of the second gaseous combustion agent takes place through a small number of large openings, and the intake of the third flow of gaseous combustion agent takes place through large openings greater in number than the intake openings for the said second flow.

12. A burner according to claim 11, wherein the total section of the said small intake openings for the said first flow of gaseous combustion agent is of the same order of magnitude as the total section of the large intake openings for the said second flow.

* * * * *